United States Patent [19]

Levinrad

[11] 4,243,225

[45] Jan. 6, 1981

[54] BOARD GAMES

[76] Inventor: Maxim D. Levinrad, PO Box 7275, Johannesburg, South Africa, 2000

[21] Appl. No.: 967,104

[22] Filed: Dec. 6, 1978

[30] Foreign Application Priority Data

Dec. 9, 1977 [ZA] South Africa ..... 77/7375

[51] Int. Cl.[3] ..... A63F 3/00

[52] U.S. Cl. ..... 273/272; 273/299

[58] Field of Search ..... 273/272, 299, 302, 275, 273/157 R; 35/70, 71, 69, 27

[56] References Cited

U.S. PATENT DOCUMENTS

| | | | |
|---|---|---|---|
| 176,532 | 4/1876 | Hughes | 35/71 |
| D. 184,396 | 2/1959 | Jenkins | 35/27 X |
| 1,257,655 | 2/1918 | Walden | 35/70 |
| 1,973,564 | 9/1934 | Graham | 273/157 R UX |
| 3,759,526 | 9/1973 | Estvan | 35/71 X |
| 3,844,568 | 10/1974 | Armstrong | 273/272 |
| 3,904,207 | 9/1975 | Gold | 273/272 |

FOREIGN PATENT DOCUMENTS

| | | | |
|---|---|---|---|
| 7413836 | 4/1976 | Netherlands | 273/272 |
| 747598 | 4/1956 | United Kingdom | 273/272 |

*Primary Examiner*—Harland S. Skogquist

*Attorney, Agent, or Firm*—Young & Thompson

[57] ABSTRACT

A game in the course of which tiles carrying portions of chosen insignia such as letters or digits are combined to form complete letters or digits which combinations carry a value which together with the values of similar adjacent combinations provide a score total in a game. Also provided for is apparatus by which the game according to the invention may be played.

3 Claims, 6 Drawing Figures

Fig 4.

| | | | | | | | | | | | | |
|---|---|---|---|---|---|---|---|---|---|---|---|---|
| x2 | | | x3 | | | x2 | | | x3 | | | x2 |
| | x2 | | | x2 | | | | x2 | | | x2 | |
| | | x3 | | | x3 | | x3 | | | x3 | | |
| x3 | | | x2 | | | x2 | | | x2 | | | x3 |
| | x2 | | | x3 | | | | x3 | | | x2 | |
| | | x3 | | | x2 | | x2 | | | x3 | | |
| x2 | | | x2 | | | * x3 | | | x2 | | | x2 |
| | | x3 | | | x2 | | x2 | | | x3 | | |
| | x2 | | | x3 | | | | x3 | | | x2 | |
| x3 | | | x2 | | | x2 | | | x2 | | | x3 |
| | | x3 | | | x3 | | x3 | | | x3 | | |
| | x2 | | | x2 | | | | x2 | | | x2 | |
| x2 | | | x3 | | | x2 | | | x3 | | | x2 |

32 PINK (x2).
25 BLUE (x3).

BOARD GAMES

This invention relates to board games and an object of the invention is the provision of a game which is in some respects similar to a currently well known board game called "Scrabble".

"Scrabble" is a word-forming game wherein a series of square tiles, each bearing a letter of the alphabet, are formed into words on a board which is divided into squares, each of which is adapted neatly to accommodate one of the tiles. Direct or cross-links between tiles on the board enable players to capitalise on each other's play with a view to obtaining the highest score, with each tile having a score value and many of the underlying board squares providing for a stipulated increase in the score value of either a word as a whole or merely in the value of an individual tile.

The present invention in principle is similar to "Scrabble" as defined above but in accordance with the invention the formation of individual letters, digits or other chosen insignia involves the use of a plurality of tiles each of which carries a portion of a chosen element.

By the word "tile" is meant a card, slab or block of natural or synthetic material which may be of a square shape, and which is preferably of substantial area compared to its thickness.

In the process of playing the game of the invention the thus formed elements may be collected into defined groups, such as words or a series of digits, and these words or collections of digits may be added to directly or by cross-links to form greater combinations which collectively have defined scoring significance.

Especially in games using digits provision may be made for the use of symbols such as plus, division, subtraction, equal and other signs which facilitate the linking of arrangements on the board to new arrangements.

In order to illustrate the invention two examples are described hereunder with reference to the accompanying drawings in which FIG. 1 illustrates a set of tiles each of which carries a portion of a letter and one blank tile;

FIG. 2 indicates the formation of letters with the pieces shown in FIG. 1;

FIG. 3 diagrammatically illustrates how letters may be utilised in the process of playing the game;

FIG. 4 shows, again diagrammatically, the form a board may take for use in the game;

Referring to the arrangement shown in FIGS. 1 to 4. In a particular example the game requires a board and 200 tiles, each tile carrying a segment of a letter, save for a selected number of tiles which are blank. It will be seen from FIG. 1 that each tile bears a value indicated by the number of dots set out thereon.

Figure 1:
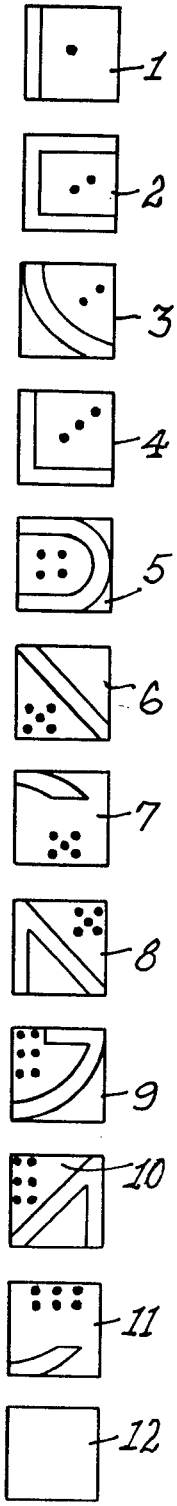

The set of 200 tiles is made up as follows, reference being to the various types of tiles illustrated in FIG. 1

Figure 2:
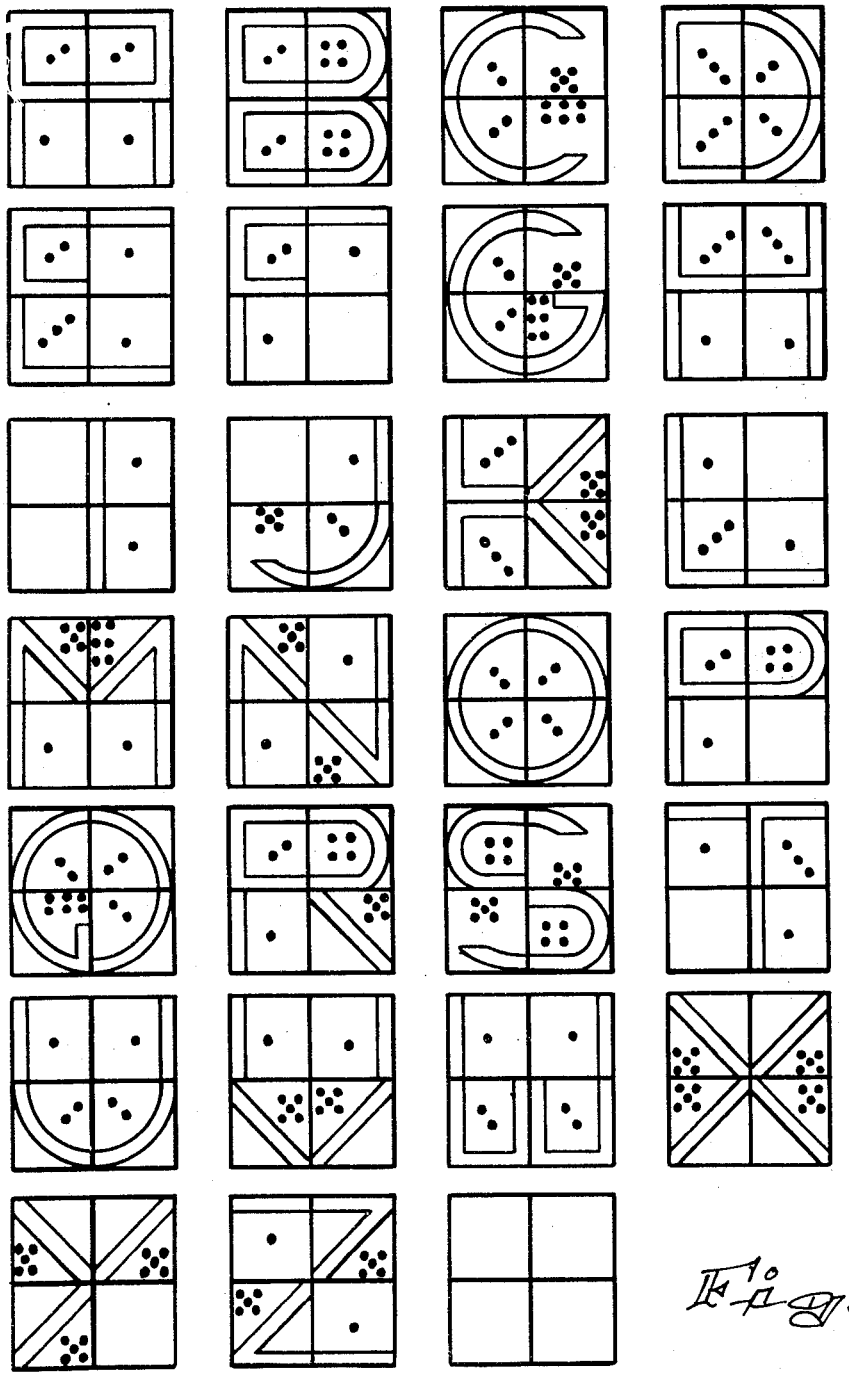
Figure 3:
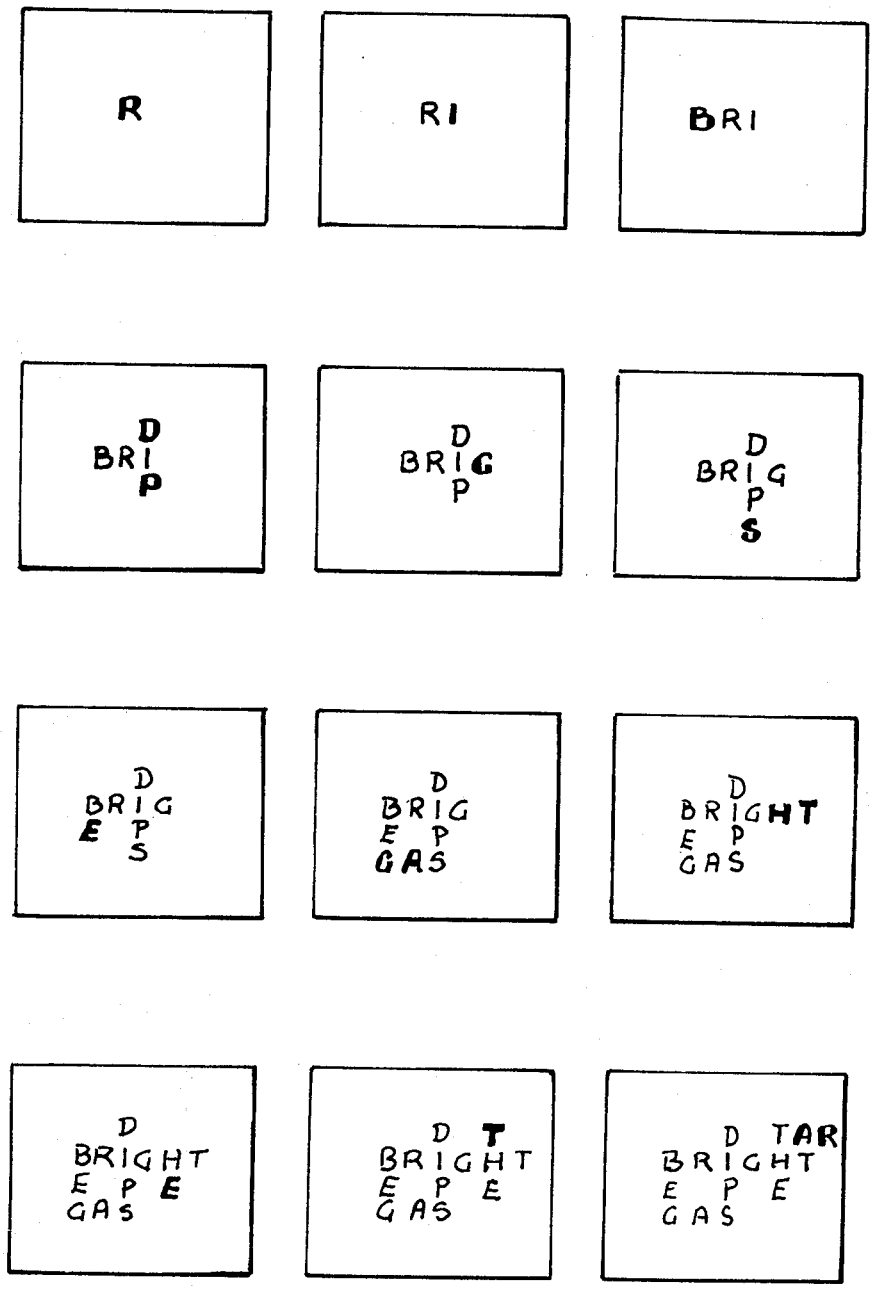

60 type 1 tiles
24 type 2 tiles
31 type 3 tiles
17 type 4 tiles
12 type 5 tiles 12 type 6 tiles
9 type 7 tiles
8 type 8 tiles
3 type 9 tiles
2 type 10 tiles
2 type 11 tiles
20 type 12 tiles The game may conveniently be played by two to four people and the play comprises the formation of individual letters by combining four tiles in the correct formation as is shown in FIG. 2; and these letters are in turn grouped together on the board shown in FIGS. 3 and 4 to form words. Each player competes for the highest score by using the tiles to the best advantage utilising where possible the premium squares which are shown in FIG. 4, these squares signifying an increase of double or treble in a word or letter value.

To begin, all tiles are turned face down at the side of the board and are well shuffled. The draw is then made to decide who starts the play, this being indicated by the player who draws the tile with the highest points. Each player then draws a specified number of tiles which normally would be of the order of twelve or other suitable multiple of four and these starting tiles are placed before each player.

The first player combines his tiles to form one, two or three letters. If he is able to make a two or three letter word with them, he places them on the board so that any one of the letters covers the central star. The points are then added and because a complete word has been made, the total score is doubled. If the player is unable to make any word, he may place a single letter over the star and his points, being the total of the tiles, trebled because the star point is of treble value.

A player completes his turn by announcing his score, and then draws from the stock pile as many tiles as he has placed on the board, thus again having 12 tiles in front of him.

Play then passes to the left and the second player will continue in one of the following ways:

(a) If there is a word on the board
- (i) he may make a new word by adding one, two or three letters which cross the existing word at right angles, thereby gaining double points for the new word formed.
- (ii) He may make a new word by adding a letter or letters to the existing word, thereby gaining double points for the new word formed.
- (iii) He may place a single letter at right angles to one of the existing letters and announce a word which starts with those letters.

(b) If there is only a letter on the board
- (i) He may make a word by placing a letter or letters before or after the existing letter.
- (iii) He may place a second letter before or after the existing letter and announce a word starting with these letters.

The following player, and then each player in sequence continues in like fashion. Any player not able to make a new word may place a letter next to an existing letter, always announcing a word starting with those letters, e.g. where a previous player placed a letter 'R' before an existing letter 'I' announcing the word 'RIP', a subsequent player may place a letter 'B' before the 'R', announcing the word 'BRIDE'. A further player may then add a letter 'G' making the word 'BRIG'—and earning double points for the complete word after taking into account any premium for the letter 'G'.

The development of the game over twelve turns is shown in FIG. 3. Bold letters indicate letters which are being played in a particular turn and the score, taking into account any premiums as indicated on FIG. 4 the scores are as follows: (premiums spaces counting only in the turn in which they are first covered).

| TURN: | LETTER PLAYED AND POSITION: | SCORE: |
|---|---|---|
| 1. | R on central star | (12 × 3) = 36 |
| 2. | I on neutral space | = 2 |
| 3. | B on neutral space | = 12 |
| 4. | D & P on Pink (×2) premium spaces completing the word DIP | 2(2 × 10 + 2 + 2 × 7) = 72 |
| 5. | G on neutral space completing the word BRIG | 2(12 + 12 + 2 + 15) = 82 |
| 6. | S on neutral space completing DIPS | (10 + 2 + 7 + 18) = 72 |
| 7. | E on pink (×2) premium space completing BE | 2(12 + 2 × 7) = 52 |
| 8. | G and E both on neutral spaces completing BEG and GAS | 2(12 + 7 + 15) +2(15 + 6 + 18) = 146 |
| 9. | H on pink (×2) premium space and T on neutral space completing BRIGHT | 2(12 + 12 + 2 + 15 + 2 × 8 + 5) = 124 |
| 10. | E on neutral space completing HE | 2(8 + 7) = 30 |
| 11. | T on neutral space completing THE | 2(5 + 8 + 7) = 40 |
| 12. | A on blue (×3) premium space and R on neutral space completing AT and TAR | 2(3 × 6 + 5) + 2(5 + 3 × 6 + 12) = 116 |

No letter may be moved once it has been placed on the board.

Blank tiles are used in forming certain letters. However, four blank tiles may be used to form a blank which can be used as any letter. The player must state the letter it represents, and this cannot be changed through the game.

Any player may use his turn to replace any or all of his tiles from the stockpile. He does so by mixing the discarded tiles face down with the others in the pool and then drawing new ones.

Any word of two or more letters defining a word in a standard dictionary may be used and play continues until all tiles have been drawn, and one of the players has used up all his tiles, or until no further moves can be made.

Any player using all 12 tiles in a single turn may be given a bonus of 50 points.

At the end of play each player's score is reduced by the sum of points on unplayed tiles.

SCORING:

(1)

(a) Letters formed on pink squares have their values doubled (b) Letters formed on blue squares have their values trebled (c) The above premiums apply only to the turn in which they are first played.

(2)

(a) The score for all new words, formed is the total of all the letters in the word, which is then doubled (b) When two or more words are formed in a turn, each word is counted as above, the common letter being counted in each word.

Clearly within the framework of the principles set out above a wide scope exists for the variation of the game. Basically the concept involves the use of a plurality of tiles to make up a single complete element which in turn is combined with other complete elements in playing the game.

Figure 5:
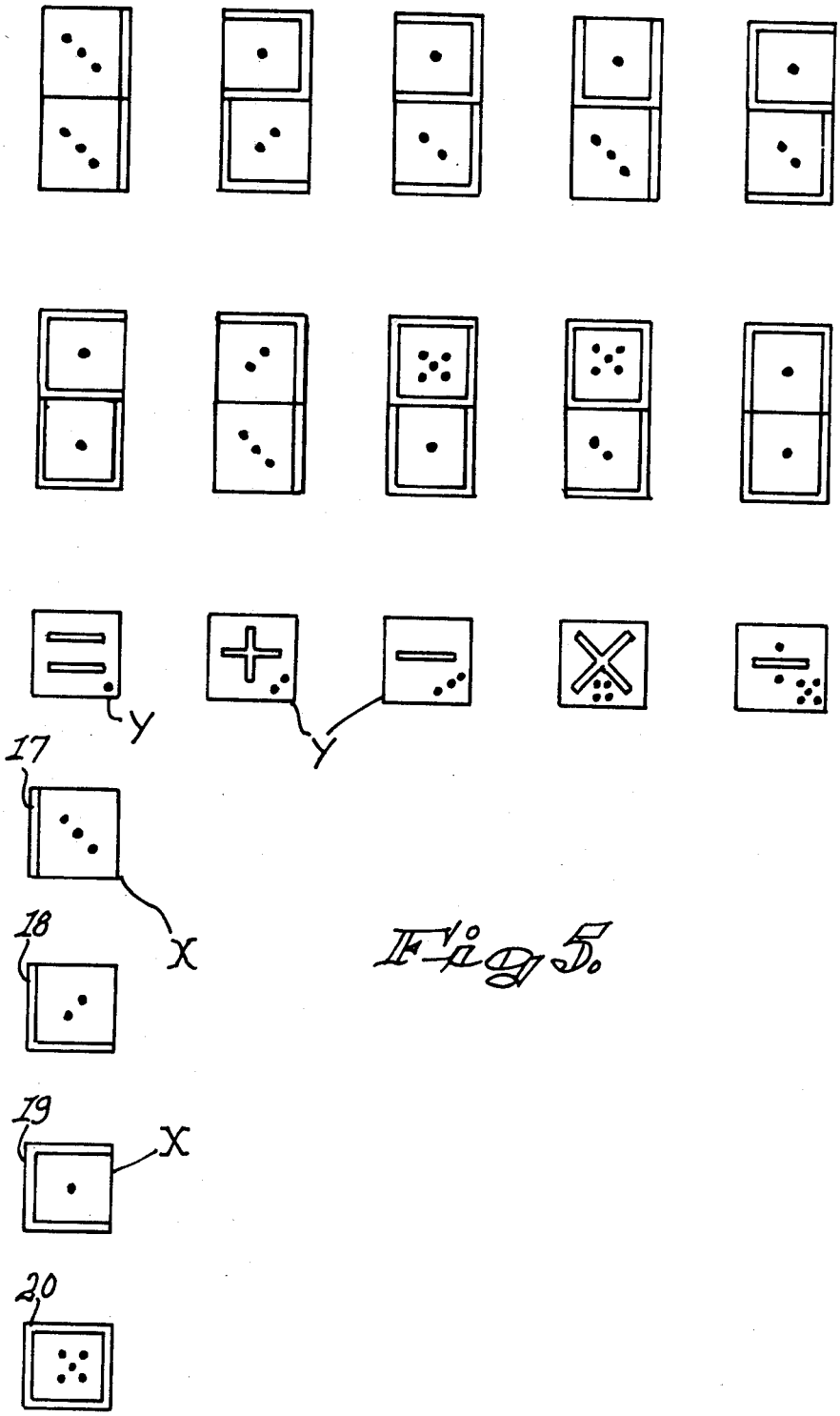
FIG. 5 illustrates a set of elements used in playing a second form of the game, a form in which digits and mathematical operator signs rather than letters are used.
Figure 6:
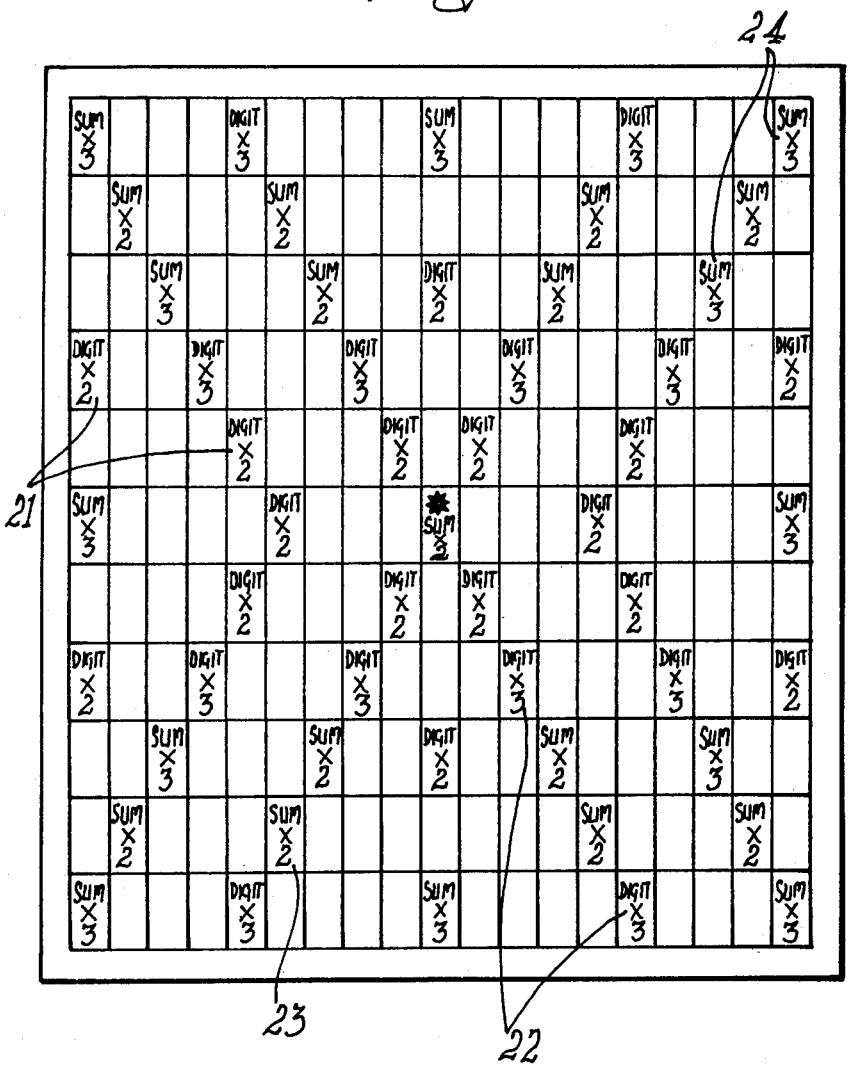
FIG. 6 shows the type of board needed when the elements shown in FIG. 5 are employed.

The second embodiment of the invention depicted in FIGS. 5 and 6 is concerned with digits. In the particular arrangement illustrated the game consists of a board and 139 tiles. Of these tiles 100 are segments of digits (X) and 39 are operator signs (Y) such as plus, minus, multiply divide and equal.

There are four different digit segments and by choosing the correct two, any digit from 1 to 0 can be formed. The four different digit segments are indicated by the references 17 to 20 in FIG. 5 and the pairing of these segments to form the required digits is illustrated at the top of FIG. 5.

The board shown in FIG. 6 is sub-divided into 209 rectangles in an 11×19 configuration. Certain of these rectangles are suitably coloured to give extra premium values to formed digits placed upon them as, for instance 16 rectangles light blue—double digit value (reference 21)

12 rectangles dark blue—treble digit value (reference 22)

13 rectangles orange—double sum value (reference 23)

12 rectangles red—treble sum value (reference 24)

The game may be played by two, three or four players. The game consists of forming digits by combining two tiles and then with the digits so formed, making up sums utilizing the necessary operator signs. The dots on each tile indicate the points, and the points scored for any sum is the total of the dots on the tiles used, taking into consideration any premiums from squares covered by the tiles. Each player competes for high scores by using his tiles in combinations and locations which take best advantage of tile values and premium squares.

To begin all tiles are turned face down at the side of the board and shuffled well. The player drawing a tile with the highest points (most dots) plays first. If there is a tie for highest, the tied players retain their tiles and draw another, taking the total of their tiles to decide who plays first. Each player then draws, say, 11 tiles and places them in front of him.

The first player pairs his digit tiles to make suitable digits and then using the digits formed, together with operator signs, makes up a sum which he places on the board so that one of the digits covers the star at the centre of the board.

A player completes his turn by announcing his score, and then draws as many tiles as he has placed on the board, thus having 11 tiles in front of him.

Play then passes to the left. The second player, and then each player in turn, makes new sums either by adding to existing sums or by making sums at right angles to existing sums, utilizing a digit or operator of each sum crossed. Digits or operators may not be on adjacent squares unless they are part of the same sum.

As an example sums may be added to as follows (a)

$4+8=12$ is changed to
$4+8=12=4\times3$ (b)

$4+8=12$ is changed to
$3+4+8=12+1+2$ and so on.

No tile may be moved after having been played and any player may use his turn to replace any or all of his tiles. He does so by re-shuffling the discarded tiles in the pool and then drawing a like amount. Play continues until all tiles have been drawn and one of the players has used all of his tiles or until no further plays may be made.

Scoring may follow the basic scheme set out below (1) Only digits placed on premium digit squares are doubled or trebled. Operator signs do not benefit from these squares.
(2) A sum is doubled or trebled when either a digit or an operator sign in that sum covers a premium sum square.
(3) Premium squares apply only in the turn in which they are first played.
(4) The score for each play is the total points of all tiles in the new sum or sums formed taking premium squares into consideration.
(5) Any player using all 11 tiles in any one turn receives a bonus of 50 points.
(6) At the end of play each player's score is reduced by the sum of points on unplayed tiles.

In order to facilitate handling of the tiles making up a complete element such as a letter, a frame member may be provided into which the individual tiles may be located and retained as a separate unit. The frame member may be of any suitable construction and may be of sheet metal, plastic or any other suitable material. Alternatively the board may be provided with rib formations, along the demarcations thus constituting a plurality of recesses on the board into which recesses the predetermined number of tiles may be neatly located and kept together when a complete letter or digit has been formed.

Many more examples of the invention exist each differing from the other in matters of detail only.

I claim:

1. A game comprising a plurality of squares tiles, classified into eleven groups identifiable by the configuration and location of a distinguishable band on the face of the tile namely tiles of Group 1 wherein the band extends along one edge of the tile;
Group 2 wherein the band extends along three adjacent edges of the tile;
Group 3 wherein the band constitutes an arc between two diagonally opposed corners of the tile;
Group 4 wherein the band extends along two adjacent edges of the tile;
Group 5 wherein the band constitutes a U-shape on the tile with the two legs of the U extending partially along two opposed edges of the tile and the arcuate section of the U forms a tangent to a third edge of the tile;
Group 6 wherein the band extends diagonally across the tile between two diagonally opposed corners thereof;
Group 7 wherein the band extends from one corner of the tile partially along an arc defined between two diagonally opposed corners of the tile;
Group 8 wherein the band extends between two diagonally opposed corners of the tile and along one edge thereof;
Group 9 wherein the band constitutes an arc between two opposed corners of the tile, the band further including a segment substantially constituting a segment of the radius of the arc described by the band and extending along one edge of the tile;
Group 10 wherein the band extends between two diagonally opposed corners of the tile and along one edge thereof, such that the tiles of Group 10 constitute mirror images of tiles of Group 8;
Group 11 wherein the band extends from one corner of the tile partially along an arc defined between two diagonally opposed corners of the tile, such that tiles of type 7 and type 11 are mirror images of one another;

and tiles of Group 12 characterised by tiles having blank faces, each of the tiles reflecting a score value, the tiles being suitable for use in the playing of a game in which players take turns to form letters by correctly combining four tiles from the various groups of tiles set out above and achieve a score in the game according to the values reflected on the combined tiles and adjacently disposed completed letters.

2. The game of claim 1 wherein the following values are marked on the tiles from the various groups:

Group 1—1 point
Group 2—2 points
Group 3—2 points
Group 4—3 points
Group 5—4 points
Group 6—5 points
Group 7—5 points
Group 8—5 points
Group 9—6 points
Group 10—6 points
Group 11—6 points
Group 12—0 points.

3. The game of claim 2 wherein the score values on the tiles are represented by a corresponding number of distinguishable dots.

* * * * *